US007794031B2

(12) United States Patent
Hsiung et al.

(10) Patent No.: US 7,794,031 B2
(45) Date of Patent: Sep. 14, 2010

(54) SLIDER ASSEMBLY

(75) Inventors: Hai-Hung Hsiung, Taipei Hsien (TW); Zhao-Guo Wen, Shenzhen (CN); Li-Hui Gao, Shenzhen (CN); Jie Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 502 days.

(21) Appl. No.: 11/845,101

(22) Filed: Aug. 27, 2007

(65) Prior Publication Data

US 2008/0303398 A1 Dec. 11, 2008

(30) Foreign Application Priority Data

Jun. 7, 2007 (CN) ..... 2007 2 0200453 U

(51) Int. Cl.
*A47B 88/00* (2006.01)

(52) U.S. Cl. ..... 312/334.46; 312/333

(58) Field of Classification Search ..... 312/333, 312/334.44–334.47; 384/21
See application file for complete search history.

(56) References Cited

U.S. PATENT DOCUMENTS

| | | | | |
|---|---|---|---|---|
| 2,277,702 | A * | 3/1942 | Kennedy | 312/334.8 |
| 5,730,514 | A | 3/1998 | Hashemi | |
| 6,220,683 | B1 | 4/2001 | Chu | |
| 6,585,337 | B1 * | 7/2003 | Chen et al. | 312/334.46 |
| 6,942,307 | B1 * | 9/2005 | Lammens | 312/334.46 |
| 6,979,067 | B2 * | 12/2005 | Yang | 312/334.46 |
| 2007/0170830 | A1 * | 7/2007 | Huang | 312/334.47 |
| 2008/0158845 | A1 * | 7/2008 | Wen et al. | 361/809 |
| 2009/0026904 | A1 * | 1/2009 | Hsiung et al. | 312/334.46 |

* cited by examiner

*Primary Examiner*—Janet M Wilkens
(74) *Attorney, Agent, or Firm*—Frank R. Niranjan

(57) ABSTRACT

A slider assembly includes a first slider (20) with a resiliently deformable positioning member (30) secured thereon, a second slider (40) slidably installed on the first slider, and a sliding member (50) slidably secured on the second slider and positioned between the first slider and the second slider. A protrusion (36) protrudes from the positioning member. The protrusion defines a receiving slot (362) therein. A restricting tab (46) protrudes from the second slider. A protrusion (52) protrudes from the sliding member. The sliding member defines a through slot (522) through the protrusion thereof for the restricting tab sliding therein. The sliding member is slidable to disengage the second slider from the first slider.

20 Claims, 4 Drawing Sheets

SLIDER ASSEMBLY

BACKGROUND

1. Technical Field

The present invention relates to slider assemblies, and more particularly to a slider assembly used in a server, a drawer and so on.

2. General Background

A slider assembly is usually used between a slidable tray and a frame, such as a server, a drawer and so on. The slider assembly includes a first slider mounted on the frame, a second slider mounted on the tray, and a locking mechanism formed on the first slider and the second slider. The first slider has two sidewalls bent from opposite edges thereof to form two slideways. One of the sidewalls defines a locking opening therein. The second slider has two sidewalls bent from opposite edges thereof for respectively sliding in the slideways of the first slider. The second slider is slidable on the first slider. A locking member is pivotably secured on the second slider. A tab extends from the locking member for engaging in the locking opening of the first slider, thereby preventing the second slider sliding out from the first slider. If it is desired to remove the second slider from the first slider, the locking member is pivoted to disengage the tab from the locking opening. Thus, the second slider can slide out from the first slider.

However, a space between the first slider and the second slider is so limited that pivotal movement of the locking member is restricted.

What is needed, therefore, is a slider assembly with a sliding member whose movement is incapable of being restricted by a limited space between a first slider and a second slider of the slider assembly.

SUMMARY

A slider assembly includes a first slider with a resiliently deformable positioning member secured thereon, a second slider slidably installed on the first slider, and a sliding member slidably secured on the second slider and positioned between the first slider and the second slider. A protrusion protrudes from the positioning member. The protrusion defines a receiving slot therein. A restricting tab protrudes from the second slider. A protrusion protrudes from the sliding member. The sliding member defines a through slot through the protrusion thereof for the restricting tab sliding therein. The sliding member is slidable relative to the second slider between a first position in which a portion of the restricting tab is exposed from the protrusion and inserted into the receiving slot, and a second position in which the portion of the restricting tab is received within the protrusion of the sliding member so that the protrusion of the sliding member deforms the positioning member and thereby passes across the protrusion of the positioning member.

Other advantages and novel features will be drawn from the following detailed description of embodiments with attached drawings, in which:

DETAILED DESCRIPTION

Figure 1:
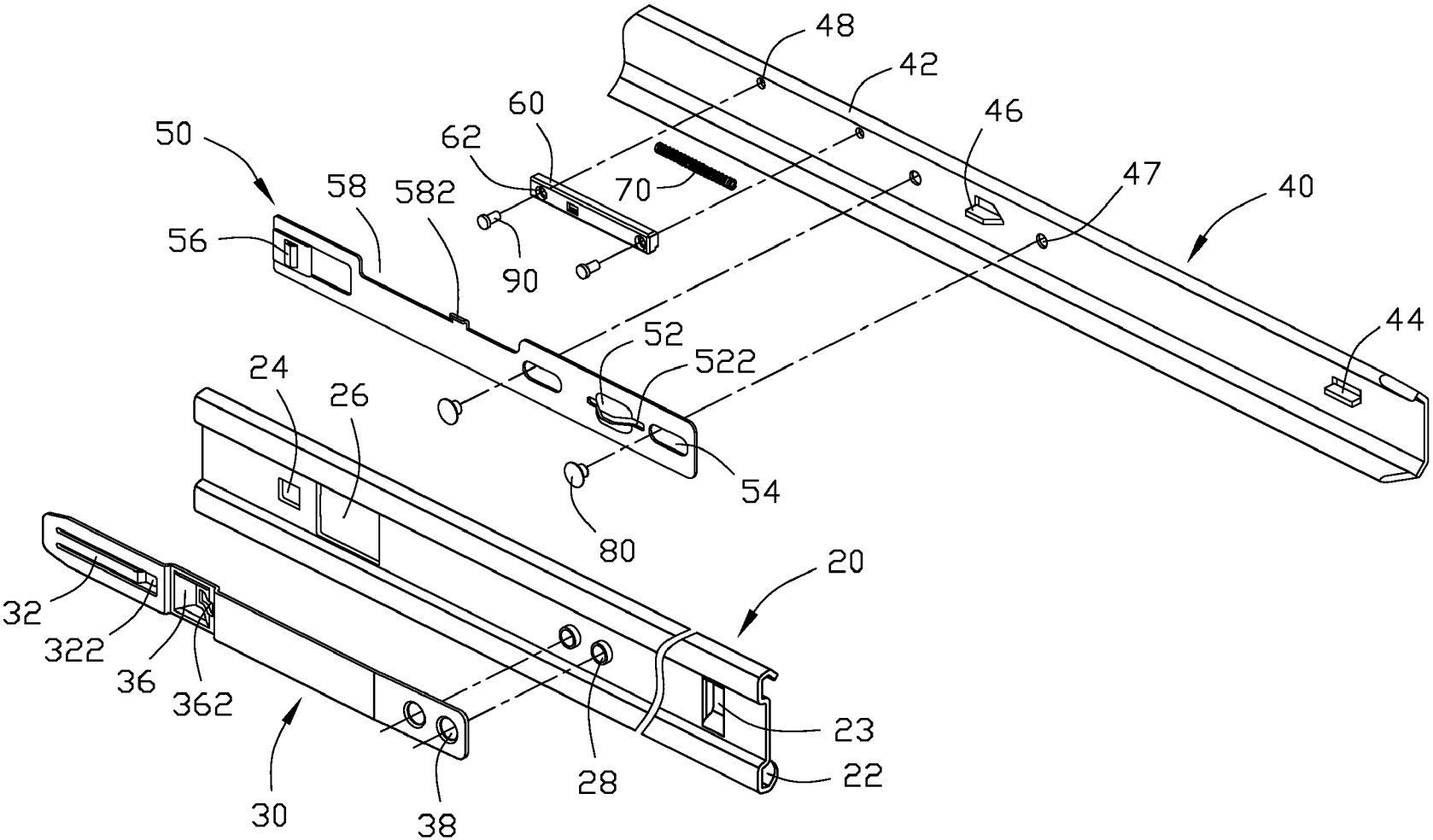
FIG. 1 is an exploded, isometric view of a slider assembly in accordance with a preferred embodiment of the present invention, the slider assembly including a first slider, a resilient positioning member, a second slider, a sliding member, a holding member, and a spring.

Referring to FIG. 1, a slider assembly in accordance with an embodiment of the present invention includes a first slider 20, a resilient positioning member 30, a second slider 40, a sliding member 50, a holding member 60, and a spring 70.

The first slider 20 has two sidewalls bent from opposite long edges thereof to form two slideways 22. A stop piece 23 protrudes in from an inner surface of the first slider 20 adjacent the right end thereof. A locking opening 24 and a through opening 26 are defined in the first slider 20, adjacent to the left end of the first slider 20. Two mounting posts 28 protrude out from an outer surface of the first slider 20 between the stop piece 23 and the through opening 26.

An elongated finger or resilient tongue piece 32 is formed in the left end of the resilient positioning member 30. A locking tab 322 is bent in from a free end of the tongue piece 32, which is away from the left end of the positioning member 30, for engaging in the locking opening 24 of the first slider 20. An arc-shaped protrusion 36 with a receiving slot 362 defined therein protrudes in from the positioning member 30, adjacent the tongue piece 32, corresponding to the through opening 26 of the first slider 20. Two mounting holes 38 are defined in the right end there of the positioning member 30, corresponding to the mounting posts 28 of the first slider 20.

The second slider 40 has two sidewalls 42 bent in from two long opposite edges thereof, for sliding in the slideways 22 of the first slider 20. A blocking tab 44 protrudes from an inner surface of the second slider 40 adjacent the right end thereof, corresponding to the stop piece 23 of the first slider 20. The blocking tab 44 is offset from the receiving slot 362 of the protrusion 36 of the positioning member 30 after the second slider 40 slides into the first slider 20. A restricting tab 46 protrudes in from the inner surface of the second slider 40, and is capable of inserting into the receiving slot 362 of the protrusion 36 of the positioning member 30 after the second slider 40 slides into the first slider 20. Two securing holes 47 are defined in the second slider 40 at opposite sides of the restricting tab 46 respectively. Two installing holes 48 are defined in the second slider 40 at one side of the securing holes 47, away from the blocking tab 44.

The sliding member 50 is capable of sliding on the second slider 40 between the sidewalls 42. A protrusion 52 protrudes out from the sliding member 50 adjacent a right end thereof. A through slot 522 is defined in the sliding member 50 through the protrusion 52, for the restricting tab 46 sliding therein. Two sliding slots 54 are defined in the sliding member 50 at opposite sides of the protrusion 52 respectively, corresponding to the securing holes 47 of the second slider 40. An operating block 56 is formed at the left end of the sliding member 50. A cutout 58 is defined in the sliding member 50, and a pushing tab 582 extends from a bottom edge of the cutout 58.

Figure 2:
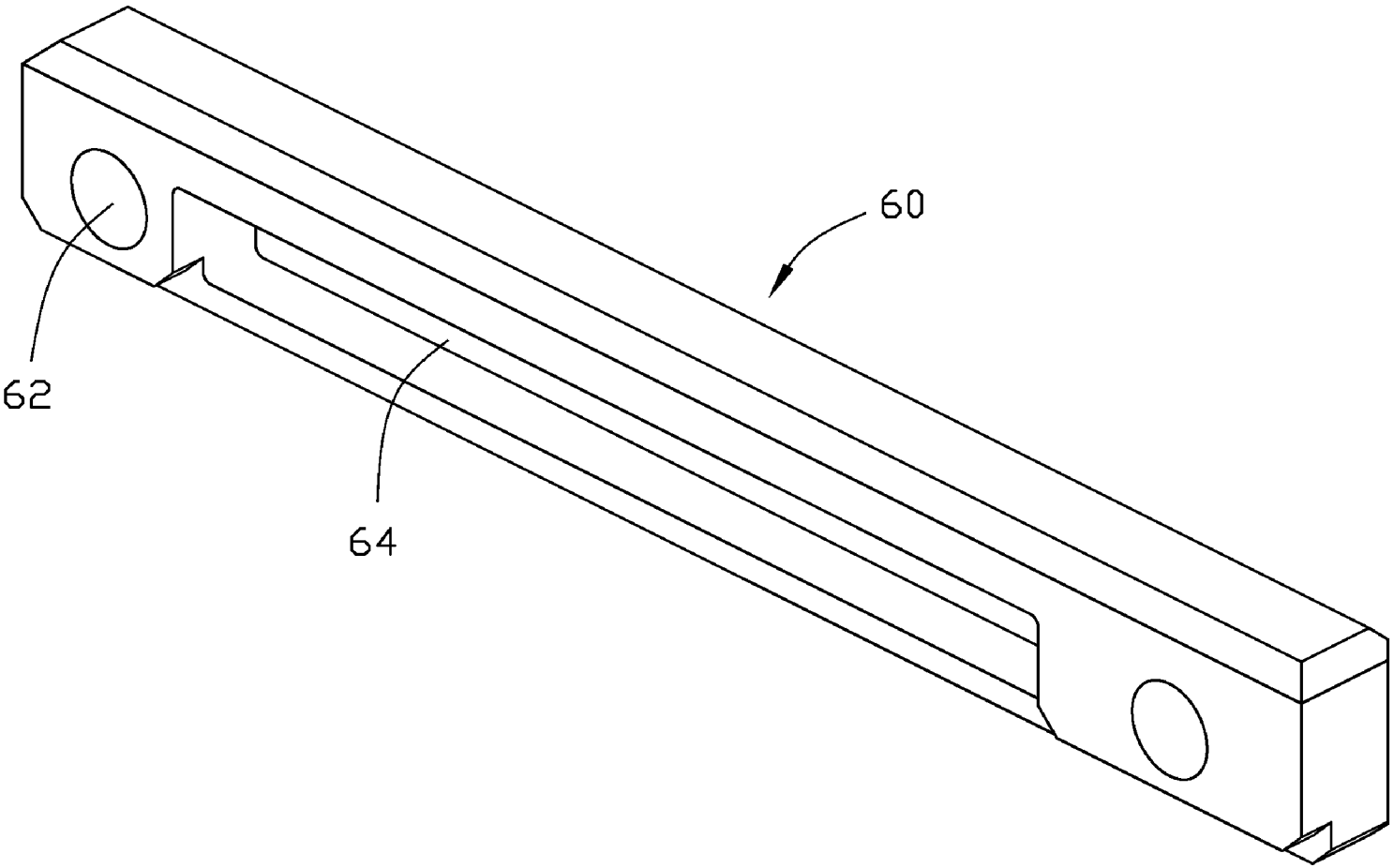
FIG. 2 is another isometric view of the holding member of FIG. 1.

Referring to FIGS. 1-2, the holding member 60 respectively defines two installing holes 62 at opposite ends thereof, corresponding to the installing holes 48 of the second slider 40. A holding space 64 is defined in the holding member 60, facing the second slider 40, for receiving the spring 70.

Figure 3:
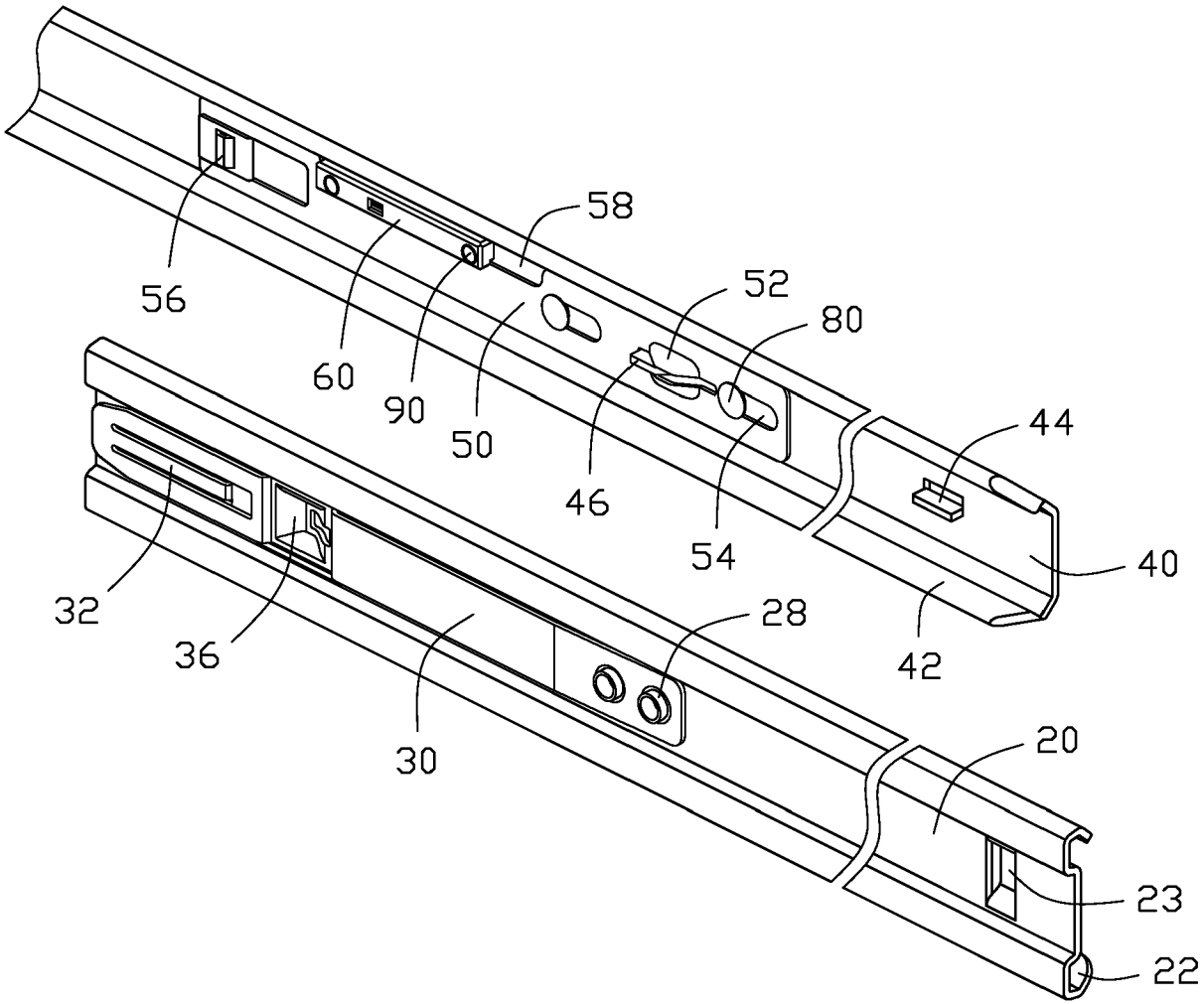
FIG. 3 is an isometric assembled view of the first slider and the resilient positioning member, and the second slider, the sliding member, the holding member and the spring.

Referring also to FIG. 3, the positioning member 30 is placed on the outer surface of the first slider 20. The mounting posts 28 of the first slider 20 are respectively inserted into the mounting holes 38 of the positioning member 30, thereby stably securing the positioning member 30 by riveting. The locking tab 322 of the tongue piece 32 is inserted into the locking opening 24 and abuts on the inner surface of the first slider 20. The protrusion 36 of the positioning member 30 is inserted into the through opening 26 of the first slider 20.

The sliding member 50 is placed on the inner surface of the second slider 40 between the sidewalls 42. The restricting tab 46 of the second slider 40 is inserted into the through slot 522 of the sliding member 50. The sliding slots 54 of the sliding member 50 are respectively corresponding to the securing holes 47 of the second slider 40. Two securing members 80, such as screws, respectively extend through the sliding slots 54 and engage in the securing holes 47, thereby slidably securing the sliding member 50 on the second slider 40. The spring 70 is received in the holding space 64 of the holding member 60, and together with the holding member 60 placed on the inner surface of the second slider 40 and positioned in the cutout 58 of the sliding member 50. The pushing tab 582 of the sliding member 50 is received into the holding space 64, and positioned at the right side of the spring 70. The installing holes 62 of the holding member 60 respectively align with the installing holes 48 of the second slider 40. Two installing members 90, such as screws, are respectively inserted through the installing holes 62 of the holding member 60 and engaged in the installing holes 48 of the second slider 40, thereby stably fixing the holding member 60 on the second slider 40.

Before the second slider 40 slides into the first slider 20, the spring 70 has an original length. At this time, the sliding member 50 is positioned in a first position. The restricting tab 46 of the second slider 40 is positioned at a left end of the through slot 522 of the sliding member 50. The securing members 80 are respectively positioned at left ends of the sliding slots 54 of the sliding member 50.

Figure 4:
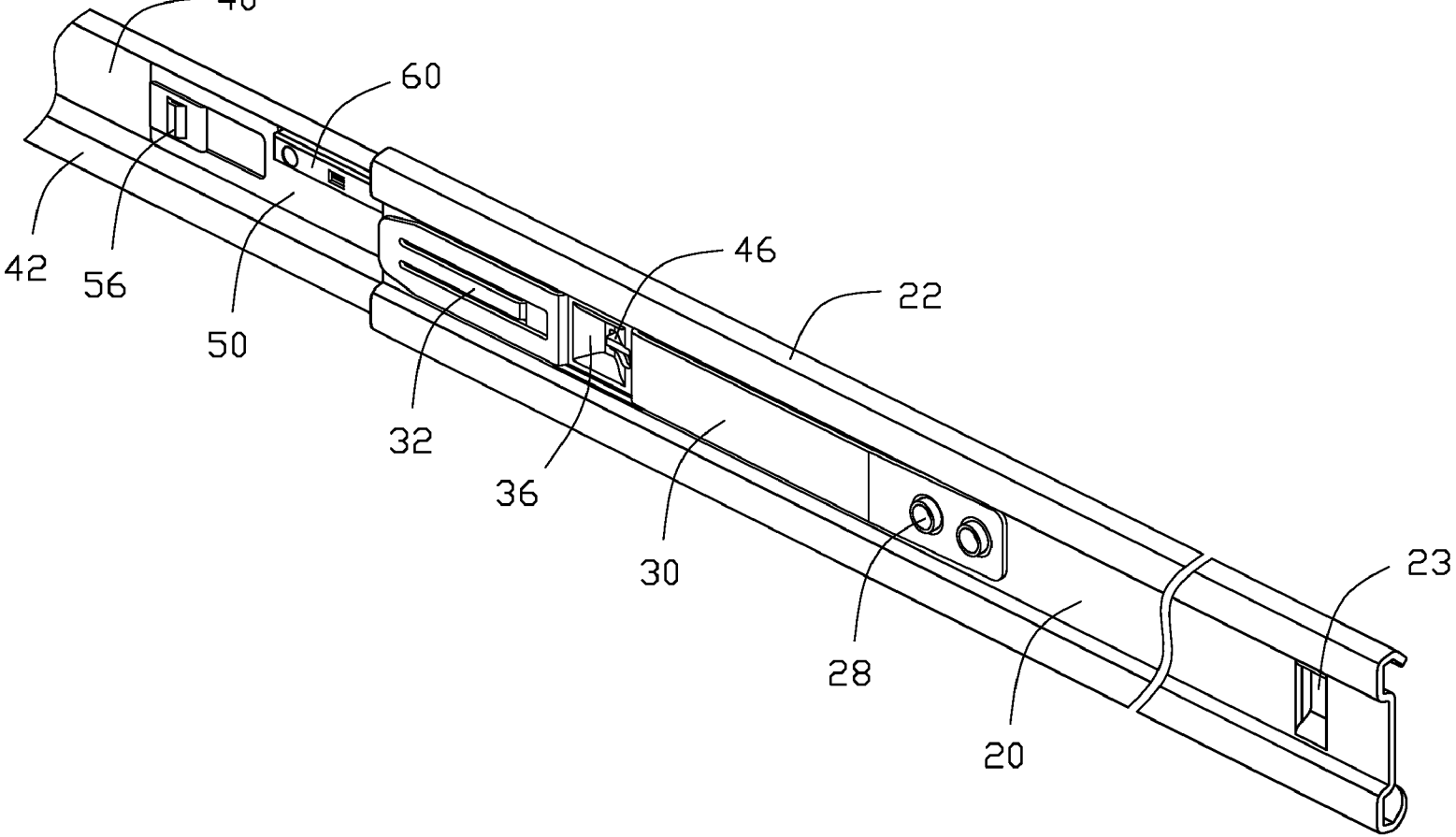
FIG. 4 is an assembled view of FIG. 1.

Referring also to FIGS. 3-4, the sidewalls 42 of the second slider 40 are inserted into the slideways 22 of the first slider 20 from the left end thereof, until the blocking tab 44 of the second slider 40 abuts on the protrusion 36 of the positioning member 30. The second slider 40 is pushed to have the blocking tab 44 pressing the protrusion 36 to resiliently deform the positioning member 30 out, so that the blocking tab 44 can pass across the protrusion 36. The second slider 40 can slide into the first slider 20 until the protrusion 52 of the sliding member 50 is stopped by the protrusion 36 of the positioning member 30. The second slider 40 is further pushed to slide on the first slider 20 to have the protrusion 52 pressing the protrusion 36 to resiliently deform the positioning member 30 out, so that the protrusion 52 can pass across the protrusion 36. The second slider 40 can further slide on the first slider 20 until the blocking tab 44 of the second slider 40 is stopped by the stop piece 23 of the first slider 20.

In removal of the second slider 40, the second slider 40 is pulled out from the first slider 20 until the restricting tab 46 of the second slider 40 is inserted into the receiving slot 362 of the protrusion 36 of the positioning member 30. The operating block 56 is pulled to slide the sliding member 50 on the second slider 40 from the first position to a second position. At this time, the restricting tab 46 is slid to a right end of the through slot 522 of the protrusion 52. The securing members 80 are respectively slid to right ends of the sliding slots 54. The pushing tab 582 of the positioning member 50 presses the spring 70 to resiliently deform to shorten. Then the second slider 40 is further pulled to slide out, the protrusion 52 presses the protrusion 36 to resiliently deform the positioning member 30 out, and thereby passes across the protrusion 36. Since the blocking tab 44 of the second slider 40 is now offset from the receiving slot 362 of the protrusion 36, the blocking tab 44 of the second slider 40 cannot insert into the receiving slot 362 of the protrusion 36 of the positioning member 30, but press the protrusion 36 to resiliently deform out the positioning member 30 when the second slider 40 is slid to abut the blocking tab 44 on the protrusion 36. The blocking tab 44 can thus pass across the protrusion 36. The second slider 40 can be taken out from the first slider 20. After the operating block 56 is released, the spring 70 rebounds to the original length, thereby pushing the pushing tab 582 to slide the sliding member 50 from the second position to the first position.

In this embodiment, the sliding member 50 is slid between the sidewalls 42 of the second slider 40 along a direction, in which the second slider 40 extends, so movement of the sliding member 50 cannot be restricted by the limited space between the first slider 20 and the second slider 40.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slider assembly, comprising:

a first slider with a resiliently deformable positioning member secured thereon, a protrusion formed on the positioning member, the protrusion defining a receiving slot therein;

a second slider slidably installed on the first slider, a restricting tab protruding from the second slider; and a sliding member slidably secured on the second slider and positioned between the first slider and the second slider, a protrusion protruding from the sliding member, the sliding member defining a through slot through the protrusion thereof for the restricting tab sliding therein, the sliding member being slidable relative to the second slider between a first position in which a portion of the restricting tab is exposed from the protrusion and inserted into the receiving slot, and a second position in which the portion of the restricting tab is received within the protrusion of the sliding member so that the protrusion of the sliding member deforms the positioning member and thereby passes across the protrusion of the positioning member.

2. The slider assembly as described in claim 1, wherein the first slider defines a through opening therein, and the protrusion of the positioning member is inserted in the through opening of the second slider.

3. The slider assembly as described in claim 2, wherein the first slider defines a locking opening adjacent the through opening, a tongue piece being formed on an end of the positioning member, and extending toward the protrusion of the positioning member, a locking tab being bent from a free end of the tongue piece for engaging in the locking opening of the first slider.

4. The slider assembly as described in claim 1, wherein a stop piece is formed on the first slider, and a blocking tab protrudes from the second slider for engaging with the stop piece.

5. The slider assembly as described in claim 4, wherein the blocking tab of the second slider is offset from the receiving slot of the positioning member.

6. The slider assembly as described in claim 1, wherein the sliding member defines a cutout therein, and a holding member is secured on the second slider and positioned in the cutout of the sliding member.

7. The slider assembly as described in claim 6, wherein the holding member defines a holding space therein, a spring being received in the holding space, a pushing tab extending from an edge of the cutout of the sliding member and inserted in the holding space at an end of the spring.

8. The slider assembly as described in claim 7, wherein the spring has an original length when the sliding member is in the first position, and is resiliently deformed when the sliding member is in the second position, the spring rebounding to the original length to slide the sliding member from the second position to the first position.

9. A slider assembly, comprising:

a first slider with a resilient positioning member secured thereon, a protrusion formed on the positioning member;

a second slider slidably installed on the first slider, a restricting tab protruding from the second slider and engaging with the protrusion of the positioning member; and a sliding member slidably secured on the second slider, a protrusion protruding from the sliding member, the sliding member defining a through slot in the protrusion thereof for the restricting tab sliding therein, the protrusion of the sliding member pressing the protrusion of the positioning member to cause the positioning member to deformably deviate away from the second slider when the sliding member is slid to disengage the restricting tab from the protrusion of the positioning member, so as to pass across the protrusion of the positioning member.

10. The slider assembly as described in claim 9, wherein the protrusion of the positioning member defines a receiving slot therein, and the restricting tab is exposed from the protrusion of the sliding member via the through slot and engages in the receiving slot.

11. The slider assembly as described in claim 9, wherein the first slider defines a through opening therein, and the protrusion of the positioning member is inserted into the through opening of the second slider.

12. The slider assembly as described in claim 11, wherein the first slider defines a locking opening adjacent the through opening, a tongue piece being formed on an end of the positioning member, and extending toward the protrusion of the positioning member, a locking tab being bent from a free end of the tongue piece for engaging in the locking opening of the first slider.

13. The slider assembly as described in claim 9, wherein a stop piece is formed on the first slider, and a blocking tab protrudes from the second slider for engaging with the stop piece.

14. The slider assembly as described in claim 9, wherein the sliding member defines a cutout therein, and a holding member is secured on the second slider and positioned in the cutout of the sliding member.

15. The slider assembly as described in claim 14, wherein the holding member defines a holding space therein, a spring being received in the holding space, a pushing tab extending from an edge of the cutout of the sliding member and inserted into the holding space at a side of the spring.

16. The slider assembly as described in claim 9, wherein the second slider defines two securing holes therein, the sliding member defining two sliding slot therein, two securing members respectively extending into the sliding slots and the corresponding securing holes, thereby slidably securing the sliding member on the second slider.

17. A slider assembly, comprising:

a first slider with a resilient positioning member secured thereon, a protrusion formed on the positioning member;

a second slider slidably installed on the first slider, a restricting tab protruding from the second slider and engaging with the protrusion of the positioning member to block the second slider from sliding on the first slider in a direction; and a sliding member slidably secured on the second slider, a protrusion protruding from the sliding member, the protrusion of the sliding member urging the protrusion of the positioning member to resiliently deform the positioning member when the sliding member is exerted to slide in the direction, and thereby disengaging the restricting tab from the protrusion of the positioning member so as to enable the second slider to further sliding on the second slider in the direction.

18. The slider assembly as described in claim 17, wherein the sliding member defines a through slot therein and through the protrusion thereof for the restricting tab sliding therein.

19. The slider assembly as described in claim 17, wherein the protrusion of the positioning member defines a receiving slot therein, and the restricting tab is exposed from the protrusion of the sliding member via the through slot and engages in the receiving slot.

20. The slider assembly as described in claim 17, wherein the first slider defines a through opening therein, and the protrusion of the positioning member is inserted into the through opening of the second slider to engage with the protrusion of the sliding member.

* * * * *